US006198446B1

(12) United States Patent
Goetz et al.

(10) Patent No.: US 6,198,446 B1
(45) Date of Patent: Mar. 6, 2001

(54) DUAL-FEED SYSTEM FOR A MULTIFUNCTION, CONFORMAL, LOADEARING STRUCTURE EXCITATION ANTENNA

(75) Inventors: Allan C. Goetz, La Jolla; Haigan K. Chea, Oceanside, both of CA (US)

(73) Assignee: TRW Inc., Redondo Beach, CA (US)

( * ) Notice: Subject to any disclaimer, the term of this patent is extended or adjusted under 35 U.S.C. 154(b) by 0 days.

(21) Appl. No.: 09/233,361

(22) Filed: Jan. 19, 1999

(51) Int. Cl.[7] ..... H01Q 1/28; H01Q 13/10

(52) U.S. Cl. ..... 343/708; 343/705; 343/767; 343/860

(58) Field of Search ..... 343/705, 708, 343/767, 770, 768, 850, 859, 860; H01Q 1/28, 13/10

(56) References Cited

U.S. PATENT DOCUMENTS

| | | | | |
|---|---|---|---|---|
| 2,701,307 | | 2/1955 | Cary | 343/705 |
| 4,245,222 | * | 1/1981 | Eng et al. | 343/725 |
| 4,672,685 | | 6/1987 | Phillips | 343/702 |
| 4,723,305 | | 2/1988 | Phillips | 343/702 |
| 4,922,259 | * | 5/1990 | Hall et al. | 343/700 MS |
| 5,825,332 | * | 10/1998 | Camacho et al. | 343/708 |

FOREIGN PATENT DOCUMENTS 2329082 11/1990 (FR) .

WO 90/13152 10/1998 (WO) .

* cited by examiner

*Primary Examiner*—Hoanganh Le
(74) *Attorney, Agent, or Firm*—Michael S. Yatsko

(57) ABSTRACT

A multifunction antenna feed structure (30) that acts as a feed for a multibandwidth antenna system (22) used in connection with a modern tactical aircraft. The feed structure (30) includes a first feed (32) and a second feed (34) electrically connected to first and second feed points on an antenna element (24) at a location where the first feed (32) is impedance matched to the VHF/FM and UHF frequency bands and the second feed (34) is impedance matched to the VHF/AM frequency band. The first and second feeds (32, 34) are positioned within a flared notch (28) between the antenna element (24) and a conductive aircraft structural component (26). The feeds (32, 34) can take on different geometrical configurations, such as cylindrical feeds, cone feeds or taper feeds. The feeds are (32, 34) electrically isolated from conductive aircraft component (26) and are electrically connected to a matching network (70, 80). The matching network (70, 80) includes a first electrical circuit (70) connected to one of the feeds (32) and a second circuit (80) electrically connected to the other feed (34). The first circuit (70) impedance matches the signal from the antenna element (24) to a transceiver circuit (18) at the VHF/FM and UHF bands, and a second circuit (80) impedance matches the second feed (34) to the transceiver circuit (18) at the VHF/AM band.

21 Claims, 5 Drawing Sheets

DUAL-FEED SYSTEM FOR A MULTIFUNCTION, CONFORMAL, LOADEARING STRUCTURE EXCITATION ANTENNA

BACKGROUND OF THE INVENTION

1. Field of the Invention

This invention relates generally to a feed system for an antenna and, more particularly, to a feed system used in connection with a low observable, multifunction, conformal, load bearing structure, excitation notch antenna on an aircraft that provides radio communications and navigation functions over several frequency bands and communication modes.

2. Discussion of the Related Art

Modern manned and unmanned tactical aircraft require radio communications over several frequency bandwidths and communication modes to support the communications, navigation and identification (CNI) functions necessary for operation of the aircraft. These radio frequency bandwidths generally include the VHF frequency modulation (FM) band (30–88 MHz), the VHF amplitude modulation (AM) band (118–174 MHz) and the UHF band (225–400 MHz). To transmit and receive these frequency bands for aircraft communications purposes, a suitable antenna system is required that is positioned on the aircraft. Known antenna systems used on tactical aircraft for CNI functions have typically included blade antennas that have a fin protruding from the surface of the aircraft. Generally, multiple blade antennas are required for the CNI functions, including one for the VHF/FM frequency band, one for the VHF/AM frequency band and another one for the UHF frequency band.

Blade antennas have a number of drawbacks when used on aircraft. These drawbacks include requiring high speed electronics for synchronously tuning the antenna and the need to efficiently couple radio frequency (rf) currents to the aircraft skin. Coupling rf signals to the conductive portions of the aircraft is a known technique that is used when the only available antenna elements are electrically small in relation to the wavelengths of the signals being transmitted and received, as is the case for the VHF/FM band. Also, because the blade antenna protrudes from the aircraft, these antennas adversely effect the aircraft's aerodynamics. Additionally, broad band, electrically small, VHF/FM blade antennas have a very low gain because they have a poor matching network efficiency and a small radiation resistance.

Moreover, the available antenna installation sites on the aircraft may not support the number of antennas needed to install the proliferating number of CNI functions, if each function requires its own antenna. Excitation antennas for supporting CNI functions are installed on aircraft at sites that are not needed by other aircraft antennas and therefore provide an efficient use of the available "real estate" on the aircraft. Additionally, because many modern tactical aircraft are low observable aircraft, it is necessary that the antenna elements conform to the aircraft structure. Known conformal antennas do not cover all of the communications bands needed for the present CNI functions.

To overcome the requirement of multiple antennas to support the CNI functions, and eliminate the need for blade antennas, U.S. Pat. No. 5,825,332, filed Sep. 12, 1996, titled "A Multifunction Structurally Integrated VHF-UHF Aircraft Antenna System", assigned to the assignee of the instant application and herein incorporated by reference, discloses an aircraft antenna that is totally integrated within the aircraft, and operates over a wide range of frequencies, including VHF/FM, VHF/AM and UHF. To operate in this manner, the antenna system uses an electrically conductive element that is part of the aircraft structure and an antenna element positioned and shaped to form a notch therebetween. The notch is generally uniform in width over part of its length and flares to a larger width over the remainder of its length. Broad band impedance matching electronics are provided to couple the antenna system to a transceiver to provide efficient transfer of energy to and from the antenna.

The broad band conformal antenna system of the '332 patent discussed above includes an antenna feed connected to the matching electronics and to a selected antenna feed point on the antenna element. The antenna feed excites the antenna element for transmission of signals, and conducts the received signals from the antenna element and electrically conductive element of the aircraft structure. The feed structure in the '332 patent is a single piece structure that provides electrical coupling between the antenna element and the matching network, but is not effective to provide the necessary coupling and impedance matching over all of the desired frequency bands of interest, including VHF/FM, VHF/AM and UHF.

What is needed is an antenna feed structure that provides impedance matched feeds for all of the frequency bands for CNI functions in connection with a single multifunction antenna. It is therefore an object of the present invention to provide such a feed structure.

SUMMARY OF THE INVENTION

In accordance with the teachings of the present invention, a multifunction antenna feed structure is disclosed that has a particular application as a feed for a multiple bandwidth antenna system used in connection with a modern tactical aircraft. The feed structure includes a first feed and a second feed electrically connected to first and second feed points on an antenna element at a location where the feeds are impedance matched to the desirable frequency bandwidths to be received and transmitted. In one embodiment, one of the feeds is impedance matched to the VHF/FM and UHF bandwidths and the other feed is impedance matched to the VHF/AM bandwidth. Also, in one embodiment, the first and second feeds are positioned within a flared notch between the antenna element and a conductive aircraft structural component. The feeds can take on different geometrical configurations, such as cylindrical feeds, cone feeds, or taper feeds.

The feeds are electrically isolated from the conductive aircraft component, and are electrically connected to a matching network. The matching network includes a first electrical circuit connected to one of the feeds and a second circuit electrically connected to the other feed. The first circuit impedance matches the signal from the antenna element to a transceiver circuit at the VHF/FM and UHF bands, and the second circuit impedance matches the second feed to the transceiver circuit at the VHF/AM band. The matching network would be positioned within the conductive aircraft component, proximate to the feed structure.

Additional objects, advantages, and features of the present invention will become apparent from the following description and appended claims, taken in conjunction with the accompanying drawings.

DETAILED DESCRIPTION OF THE PREFERRED EMBODIMENTS

The following discussion of the preferred embodiments directed to a feed structure for use with a multifunction, conformal load bearing structure, excitation antenna for supporting CNI functions in a tactical aircraft is merely exemplary embodiment, and is in no way intended to limit the invention or its applications or uses.

Figure 1:
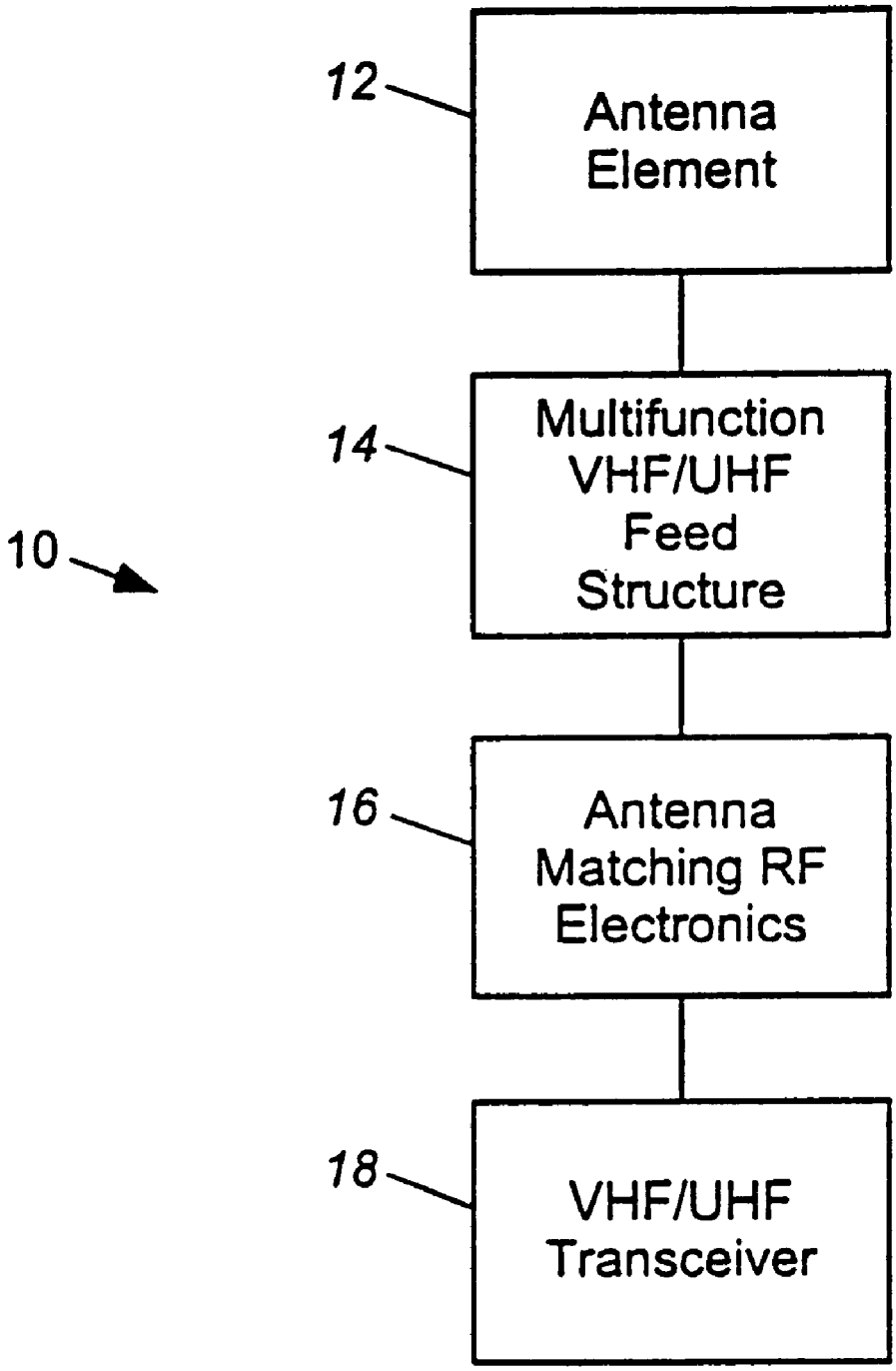
FIG. 1 is a block diagram showing the general components of an antenna system for an aircraft.

FIG. 1 is a block diagram showing some of the basic components of a communications system 10 of the type used in connection with a modern tactical aircraft, such as a military aircraft (not shown), for CNI functions in the VHF/FM, VHF/AM and UHF frequency bands. The communications system 10 includes an antenna element 12, a multifunction VHF/UHF feed structure 14, antenna matching rf electronics 16, and a VHF/UHF transceiver 18 electrically connected together in a manner that would be well understood to those skilled in the art. Each of the antenna element 12, the feed structure 14, the matching electronics 16 and the transceiver 18 would be positioned within or on the aircraft at any suitable location that conforms with the discussion below, within the skill of the art. The antenna element 12 receives electromagnetic radiation for reception purposes or transmits electromagnetic radiation for transmission purposes at the desirable frequency bands. When the system 10 is in a reception mode, the antenna element 12 receives the signals at the desirable frequency bandwidths, and the signals are directed to the transceiver 18 through the feed structure 14 and the matching electronics 16. When the system 10 is in the transmission mode, the transceiver 18 sends a signal to the matching electronics 16 that is directed to the antenna element 12 through the feed structure 14 for transmission purposes.

The antenna element 12 can be any suitable antenna element known in the art for the particular applications discussed herein. The multifunction feed structure 14 forms part of the present invention, and is connected to the antenna element 12 at the desired impedance matched feedpoints at the VHF/FM, VHF/AM and UHF frequency bands, as will be discussed in more detail below. The feed structure 14 directs the signals received from the element 12 to the matching electronics 16, or directs the signals from the matching electronics 16 to be transmitted by the antenna element 12. The matching rf electronics 16 also forms part of the present invention, and converts the feedpoint impedance to the transceiver 18 output impedance, usually 50 ohms, as will also be discussed in more detail below.

Figure 2:
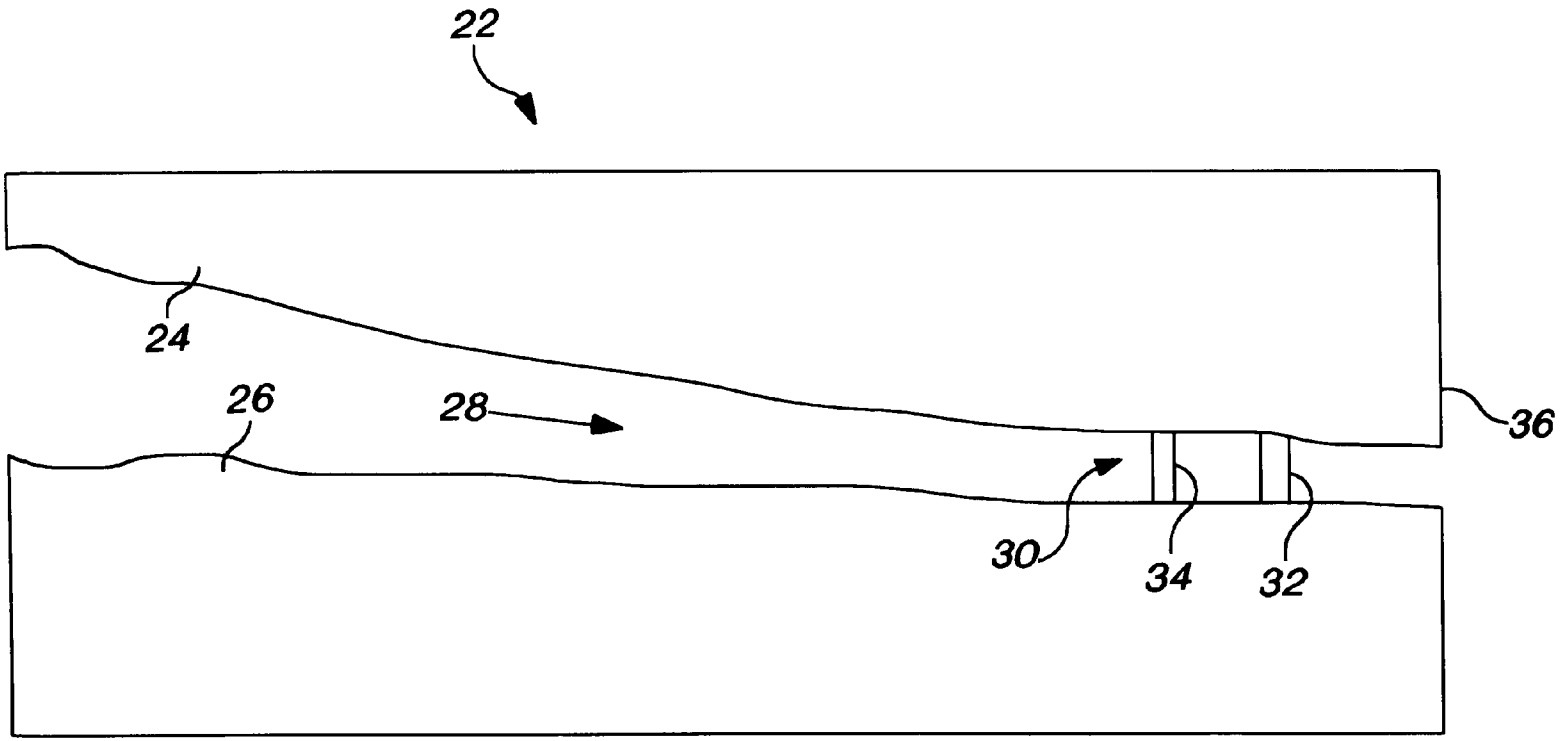
FIG. 2 is a multifunction antenna feed structure including multiple cylindrical feeds, according to an embodiment of the present invention.

FIG. 2 is a plan view showing an antenna structure 22, according to an embodiment of the invention. The antenna structure 22 includes an antenna element 24 positioned relative to a conductive aircraft structural component 26 at a location that defines a gap or notch 28 therebetween. The aircraft component 26 can be a tail, wing, stabilizer, or other aircraft structure of an aircraft, as long as it is electrically conductive. The antenna element 24 and the aircraft component 26 define a notch antenna of the type disclosed in the '332 patent, where the notch 28 has substantially the same width along some portion of the component 26, and then flares uniformaly and continuously anycriticality or expands to a greater dimension along the remaining portion of the aircraft component 26, as shown. Both the antenna element 24 and the aircraft component 26 are excited as a result of the currents flowing in these structures from transmitted signals from the transceiver 18 or electromagnetic signals received from the air. These currents create electromagnetic fields in the notch 28. The notch 28 radiates generally omnidirectionally, and both the antenna element 24 and the component 26 radiate as a result of the currents flowing in these structures. As discussed in the '332 patent, the combined antenna element 24 and conductive component 26 is responsive to and transmits electromagnetic radiation in the VHF/FM, VHF/AM and UHF communications bands for CNI functions. The notch antenna is also capable of operation in other frequency bands.

In order to couple the antenna element 24 to the matching electronics 16, a feed structure 30 is positioned within the notch 28, and includes a first antenna feed 32 and a second antenna feed 34. In this configuration, the first feed 32 is an aft feed positioned towards the back of the aircraft component 26, and the second feed 34 is a fore feed positioned towards the front of the aircraft component 26. The feeds 32 and 34 are connected to the antenna element 24 at predefined feed point locations so that they are connected at the appropriate impedance levels for the desired frequency bands to be received or transmitted by the antenna element 24. The feeds 32 and 34 are connected to, but electrically isolated from the component 26. According to one embodiment, the aft feed 32 is connected to the appropriate impedance feed point location on the element 24 to collect the UHF and VHF/FM frequency bands, and the fore feed 34 is connected to the appropriate impedance feed point location on the element 24 to collect the VHF/AM frequency band. The width of the notch 28 between the antenna element 24 and the aircraft structure 26 is critical in that if this spacing is too small, the feed point admittance where the feeds 32 and 34 connect to the element 24 and the component 26 will be adversely affected by excessive capacitive reaceptance. The actual width of the notch 28 would be determined by optimization tests for a particular aircraft.

In this embodiment, the feeds 32 and 34 are cylindrical, and are of a suitable length to accommodate the desirable width of the notch 28 for different applications. The feeds 32 and 34 can be made of any suitable conductive material, such as brass, gold, nickel, etc. The matching electronics 16 would be housed in the aircraft component 26 as close to the feed structure 30 as possible for impedance matching purposes. The aft feed 32 would be positioned relative to a trailing edge 36 of the antenna element 24 and the fore feed 34 would be positioned as close to the aft feed 32 as suitable depending on the particular wavelengths and aircraft body style. Typically, the feeds 32 and 34 would be within about one and two inches of each other center-to-center, and the diameter of the feeds 32 and 34 would be about one-eighth of an inch for the CNI functions.

Figure 3:
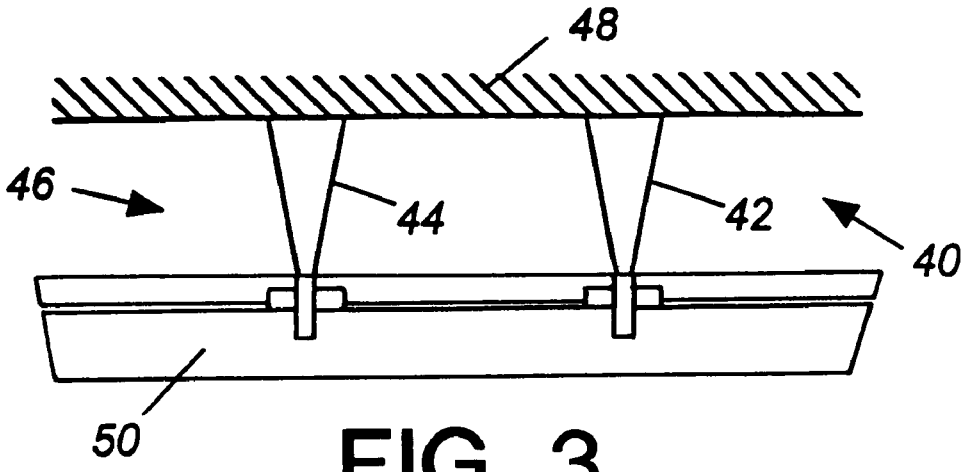
FIG. 3 is a multifunction antenna feed structure including multiple cone feeds, according to another embodiment of the present invention.

The cylindrical design of the feeds 32 and 34 is disclosed by way of a non-limiting example in that other feed shapes may be equally applicable or suitable to transfer signals to and from the antenna element 24 in an impedance matched manner for different aircraft designs. FIG. 3 shows a feed structure 40 including a first feed 42 and a second feed 44 that are conical in shape and are positioned within a notch 46 away from the preceeding flared configuration (not shown), between an antenna element 48 and an aircraft structure 50, and are connected to the element 48 at the feedpoint locations. The larger end of the conical feeds 42 and 44 is connected to the antenna element 48, and the smaller end of the feeds 42 and 44 is connected to the aircraft structure 50. In one embodiment, the large opening of the feeds 42 and 44 has a diameter of about one-half inch, and the opposite end of the feeds 42 and 44 is about 0.060 inches. The conical feed configuration of the feeds 42 and 44 may provide increased performance over the cylindrical feeds 32 and 34, but the cylindrical feeds 32 and 34 may provide increased manufacturability and assembly. The operation of the feeds 42 and 44 is the same as the feeds 32 and 34 above, but provide a different configuration for different aircraft designs and manufacturing processes.

Figure 4:
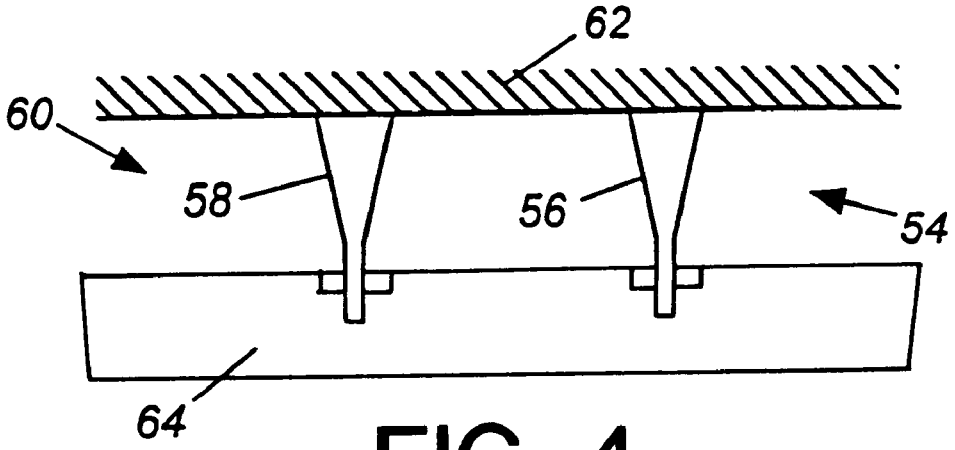
FIG. 4 is a multifunction antenna feed structure including multiple tapered feeds, according to another embodiment of the present invention.

FIG. 4 shows a third embodiment of a feed structure 54 including an aft feed 56 and a fore feed 58 having a tapered configuration, and positioned within the constant width region of a notch 60. The wider end of the tapered feeds 56 and 58 is connected to an antenna element 62, and the narrower end of the feeds 56 and 58 is connected to a conductive aircraft structure 64. As above, the feeds 56 and 58 are connected at an impedance matched feed point for receiving or transmitting signals to the antenna element 62 at the VHF/FM, VHF/AM and UHF frequency bands. The flat tapered structure of the feeds 56 and 58 offer ease of manufacture in that these feeds can be readily stamped out of a conductive board.

Figure 5:
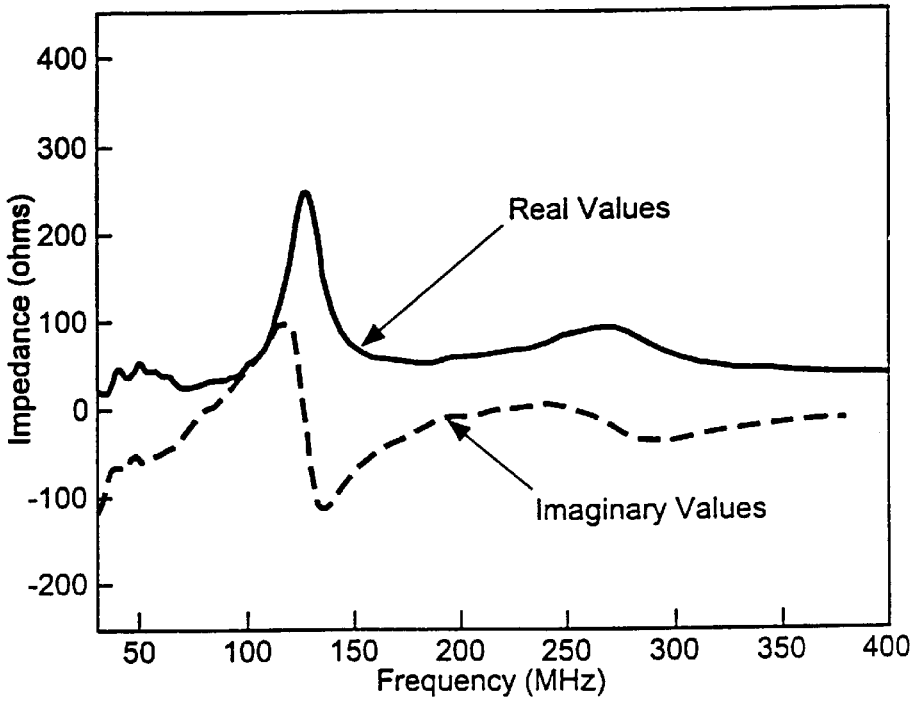
FIG. 5 is a graph showing frequency on the horizontal axis and impedance on the vertical axis for the input impedance of one of the feeds shown in FIG. 1.
Figure 6:
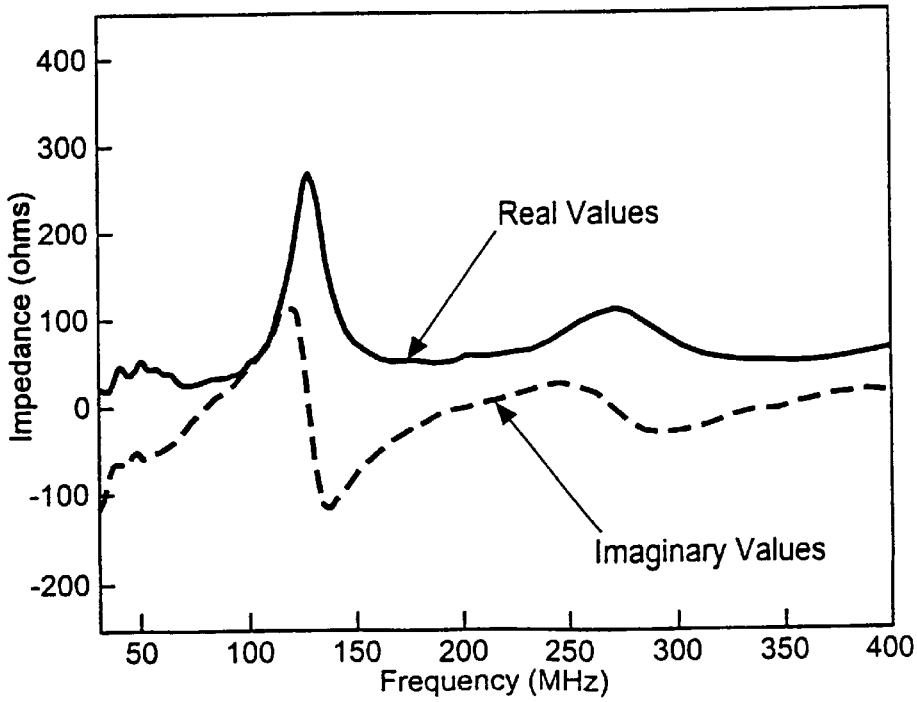
FIG. 6 is a graph showing frequency on the horizontal axis and impedance on the vertical axis for the input impedance of the other feed shown in FIG. 1.

FIG. 5 is a graph with frequency in megahertz on the horizontal axis and impedance in ohms on the vertical axis. The graph lines in FIG. 5 show the real and imaginary values of the measured impedance of the feed 32, 42 or 56 when the respective feed 34, 44 or 58 is opened. FIG. 6 shows graph lines of the real and imaginary values of the measured impedance of the feed 34, 44 or 58 when the respective feed 32, 42 or 56 is opened. These graphs depict the performance of the antenna feed structures of the invention. The shown characteristic is more easily matched than those typical of a blade antenna because of the large real impedance values.

Figure 7:
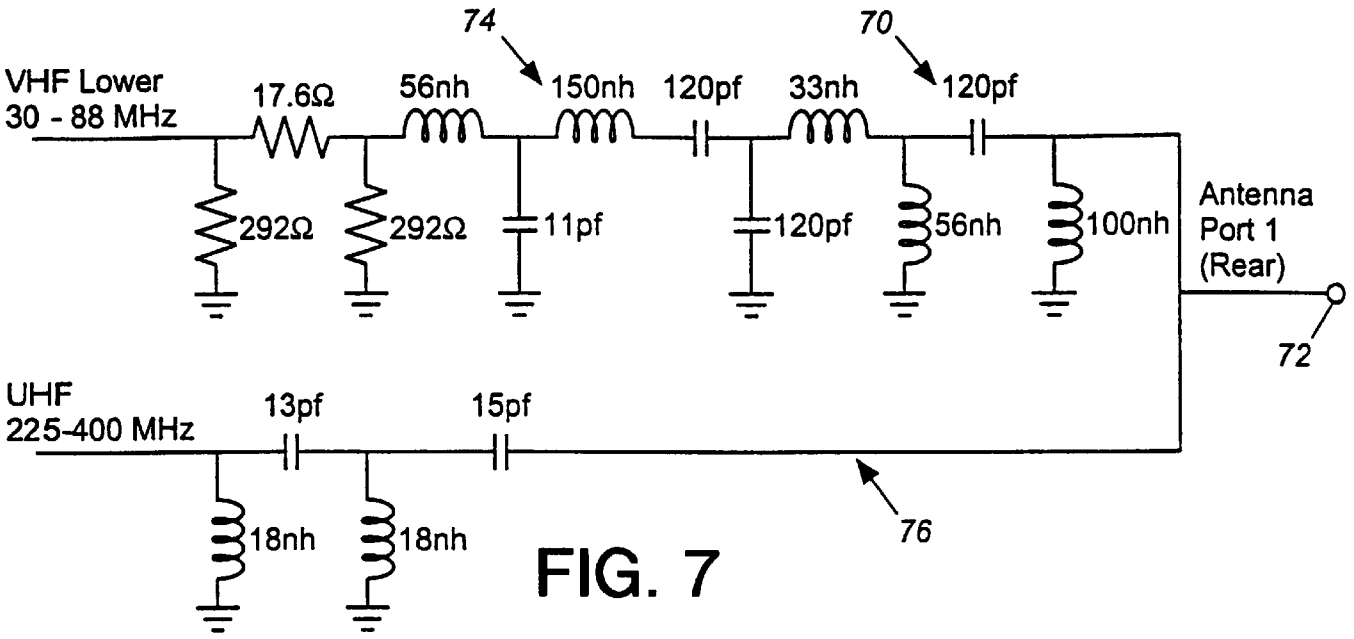
FIG. 7 is a schematic diagram of a matching network connected to one of the feeds shown in FIGS. 2–4, according to an embodiment of the present invention.

In order to achieve high efficiency, a low-loss wide band impedance matching network is provided that has an impedance transformation from the frequency varying antenna impedance to the 50 ohm impedance of the transceiver 18. This impedance matching network is specific to each antenna configuration, and is physically part of the feed structure and uses the lowest loss passive components possible. FIG. 7 is a schematic diagram depicting a matching network 70, according to the invention, that includes an antenna port 72 connected to one of the feeds 32, 42 or 56. A first channel line 74 of the network 70 includes a plurality of resistors, inductors and capacitors electrically connected as shown that provides impedance matching for the VHF/FM frequency band between the transceiver 18 and feed 32, 42 or 56. The resistive values are in ohms (Ω), the capacitive values are in picofarads (pf) and the inductive values are in nanohenries (nh). A second channel line 76 of the network 70 includes capacitors and inductors electrically connected as shown that provide impedance matching for the UHF frequency band between the transceiver 18 and the feed 32, 42 or 56.

Figure 8:
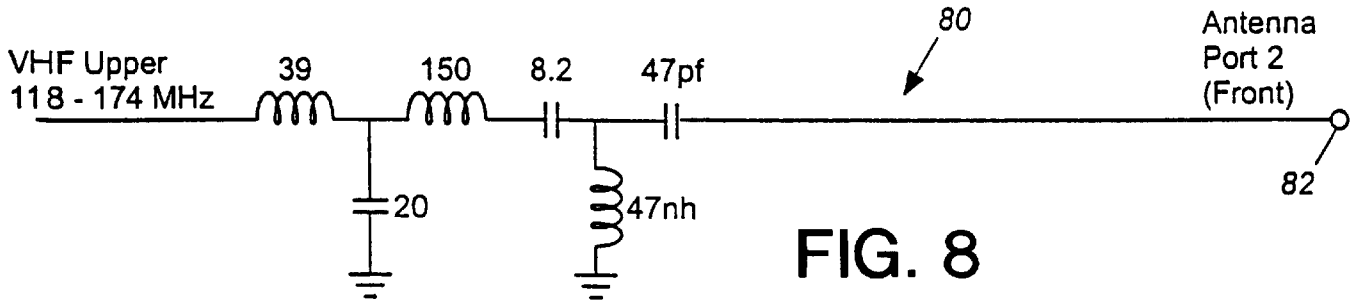
FIG. 8 is a schematic diagram of a matching network connected to the other of the feeds shown in FIGS. 2–4, according to an embodiment of the present invention.

FIG. 8 shows a schematic diagram of a matching network 80, according to the invention, that is connected to one of the feeds 34, 44 or 58 at an antenna port 82. The network 80 includes a plurality of resistors, inductors, and capacitors electrically connected as shown that provide impedance matching for the VHF/AM frequency band between the transceiver 18 and the feed 34, 44 or 58. The actual physical layout of a multifunction matching network positioned within the component 26, combines both of the matching networks 70 and 80 on a common circuit board.

The multifunction dual feed of the invention is an efficient way of simultaneously transmitting and receiving signals in three frequency channels. The excellent signal isolation between the channels reduces signal interference.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. An antenna feed system for directing antenna signals to and from receiver and transmission circuitry, said system comprising:

a conductive structure;

an antenna element positioned adjacent to the conductive structure so as to define a notch therebetween;

a first antenna feed connected to the antenna element at a first feed point location so as to be impedance matched to the antenna element at a first bandwidth said first feed extending across the notch and being coupled to the conductive structure; and a second antenna feed connected to the antenna element at a second feed point location so as to be impedance matched to the antenna element at a second bandwidth, said second feed extending across the notch and being coupled to the conductive structure, wherein the first bandwidth has a different frequency than the second bandwidth, said first and second feeds being impedance matched to the antenna element to be at the first and second bandwidths.

2. The system according to claim 1 wherein the antenna element is shaped so that the notch has a uniform width along a portion of its length and a flared width along a remaining portion of its length.

3. The system according to claim 1 further comprising multifunction matching electronics that impedance match the first and second feeds to the receiver and/or transmission circuitry.

4. The system according to claim 3 wherein the matching electronics includes a first matching circuit and a second matching circuit, each matching circuit including resistor, inductor and capacitive components, said first matching circuit providing impedance matching at the first bandwidth and said second matching network providing impedance matching at the second bandwidth.

5. The system according to claim 1 wherein the first and second feeds have a shape selected from the group consisting of cylinders, cones and tapered structures.

6. The system according claim 1 wherein the first antenna feed is connected to the first antenna feed point to pass VHF/FM and UHF frequencies and the second antenna feed is connected to the second antenna feed point to pass VHF/AM frequencies.

7. The system according to claim 1 wherein the first and second feeds are positioned within two inches of each other.

8. The system according to claim 1 wherein the antenna element is a single piece antenna structure.

9. A multifunction antenna system used in connection with receiver and transmission circuitry on an aircraft, said receiver and transmission circuitry operating over a plurality of frequency bands and modes, said system comprising:

a conductive aircraft structural element forming part of the outer structure of the aircraft;

an antenna element positioned adjacent to the aircraft structural element and forming a notch therebetween; and a feed structure positioned within the notch, said feed structure including a first antenna feed element and a second antenna feed element, said first and second feed elements being separate elements and being in electrical connection with the antenna element at a first feed point and a second feed point, wherein the first feed element and the second feed element are impedance matched to the antenna element so that the first feed element passes frequency signals at a first frequency band and the second feed element passes frequency signals at a second frequency band, wherein the first bandwidth has a different frequency than the second bandwidth.

10. The system according to claim 9 wherein the aircraft structural element is part of an aircraft structure selected from the group consisting of a wing, a tail and a stabilizer.

11. The system according to claim 9 wherein the first feed element is a fore feed element and the second feed element is an aft feed element where the fore feed element is closer to the front of the aircraft than the aft feed element.

12. The system according claim 11 wherein the first antenna feed element passes the VHF/AM frequency band and the second antenna feed element passes the VHF/FM and UHF frequency bands.

13. The system according to claim 9 further comprising multifunction matching electronics that impedance match the first and second feed elements to the receiver and transmission circuitry.

14. The system according to claim 13 wherein the matching electronics includes a first matching circuit and a second matching circuit, said first matching circuit being connected to the first feed element and providing impedance matching at the first frequency band and the second matching circuit connected to the second feed element and providing impedance matching for the second frequency band.

15. The system according to claim 13 wherein the matching electronics is positioned within the aircraft structural element.

16. The system according to claim 9 wherein the antenna element has a predefined shape so that a portion of the length of the notch has a uniform width and a remaining portion of the notch has a flared width.

17. The system according to claim 9 wherein the first and second feed elements have a shape selected from the group consisting of cylinders, cones and tapered structures.

18. The system according to claim 9 wherein the first and second feed elements are positioned within an inch and a half of each other.

19. A multifunction antenna system used in connection with receiver and transmission circuitry on an aircraft, said receiver and transmission circuitry operating over a plurality of frequency bands and modes, said system comprising:

a conductive aircraft structural element forming part of the outer structure of the aircraft;

an antenna element positioned adjacent to the aircraft structural element and forming a notch therebetween, said antenna element being shaped so that a portion of the length of the notch has a uniform width and the remaining portion of the notch is flared;

multifunction matching electronics positioned within the structural element; and a feed structure positioned within the notch, said feed structure including a fore antenna feed element and an aft antenna feed element, said fore and aft feed elements being separate elements and being in electrical connection with the antenna element at a first feed point and a second feed point, wherein the fore feed element and the aft feed element are impedance matched to the antenna element so that the aft feed element passes frequency signals in the VHF/FM and the UHF frequency bands and the fore feed element passes frequency signals in the VHF/AM frequency band, and wherein the multifunction matching electronics provides impedance matching between the fore and aft feed elements and the receiver and transmission circuitry.

20. The system according to claim 19 wherein the first and second feeds have a shape selected from the group consisting of cylinders, cones and tapered structures.

21. The system according to claim 19 wherein the matching electronics includes a first matching circuit and a second matching circuit, each including resistor, inductor and capacitive components, said first matching circuit is connected to the fore feed element and provides impedance matching at the VHF/AM frequency band and the second matching network is connected to the aft feed element and provides impedance matching at the VHF/FM and UHF frequency bands.

* * * * *